US007959795B2

(12) United States Patent
Ho et al.

(10) Patent No.: US 7,959,795 B2
(45) Date of Patent: Jun. 14, 2011

(54) DEEP HYDRODESULFURIZATION OF HYDROCARBON FEEDSTREAMS

(75) Inventors: Teh C. Ho, Bridgewater, NJ (US); Garland B. Brignac, Clinton, LA (US); Zhiguo Hou, Nazareth, PA (US); Michael C. Kerby, Center Valley, PA (US); Tahmid I. Mizan, Bridgewater, NJ (US); William E. Lewis, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 556 days.

(21) Appl. No.: 12/220,170

(22) Filed: Jul. 22, 2008

(65) Prior Publication Data

US 2010/0018905 A1 Jan. 28, 2010

(51) Int. Cl.
*C10G 45/02* (2006.01)

(52) U.S. Cl. ..... 208/217; 208/208 R; 208/209; 208/213; 208/216 R; 208/243; 208/244

(58) Field of Classification Search ..... 208/208 R, 208/209, 213, 216 R, 217, 243–244, 254 R, 208/254 H See application file for complete search history.

(56) References Cited

U.S. PATENT DOCUMENTS

| | | | | |
|---|---|---|---|---|
| 6,338,793 | B1 * | 1/2002 | Putman | 208/213 |
| 6,416,659 | B1 * | 7/2002 | Groten et al. | 208/213 |
| 2003/0168383 | A1 | 9/2003 | Hoekstra et al. | |

OTHER PUBLICATIONS

Ho, T.C. (2003). Journal of Catalysis, 219, 442-451.*

Brune, M.; Sawady W.; Reimert, R., "Desulfurization of liquid fuels using partial vaporization and associated hydrogenation in the gas phase Entschwefelung flussiger brennstoffe mittels partieller verdampfung und anschliessender hydrierung in der gasphase", Chemie-Ingenieur-Technik 78/9, 1324 (Sep. 2006). ISSN: 0009-286X.

Murali, C.; Voolapalli, R.K.; Ravichander, N.; Gokak, D.T.; Choudary, N.V., "Trickle bed reactor model to simulate the performance of commercial diesel hydrotreating unit", Fuel 86 (2007) pp. 1176-1184.

Collins, George M.; Hess, Richard K.; Hook, Bruce D.; Akgerman, Aydin, "Modeling of Trickle Bed Reactors at High Temperatures and Pressures with Volatile Feeds", Kinetics, Catalysis and Reaction Engineering Laboratory, Department of Chemical Engineering, Texas A&M University.

* cited by examiner

*Primary Examiner* — Walter D Griffin
*Assistant Examiner* — Brian McCaig

(57) ABSTRACT

The distillate catalytic hydrodesulfurization of hydrocarbon fuels wherein the optimum hydrogen treat gas rate to maximize desulfurization is determined and introduced into the reaction zone to maintain a controlled amount of hydrogen at the surface of the catalyst during hydrodesulfurization.

17 Claims, 1 Drawing Sheet

DEEP HYDRODESULFURIZATION OF HYDROCARBON FEEDSTREAMS

FIELD OF THE INVENTION

This invention relates to the distillate catalytic hydrodesulfurization of hydrocarbon fuels wherein the optimum hydrogen treat gas rate to maximize desulfurization is determined and introduced into the reaction zone to maintain a controlled amount of hydrogen at the surface of the catalyst during hydrodesulfurization.

BACKGROUND OF THE INVENTION

Environmental and regulatory initiatives are requiring ever-lower levels of both sulfur and aromatics in transportation fuels. Sulfur limits for distillate fuels to be marketed in the European Union are already at 50 wppm, or less. There are also regulations that require lower levels of total aromatics in hydrocarbons and, more specifically, lower levels of multi-ring aromatics in transportation fuels, as well as for heavier hydrocarbon products. Further, the maximum allowable aromatics level for U.S. on-road diesel, California Air Resources Board (CARB) reference diesel, and Swedish Class I diesel are 35, 10 and 5 vol %, respectively. The CARB and Swedish Class I diesel fuel regulations allow no more than 1.4 and 0.02 vol % polynuclear aromatics, respectively. Consequently, much work is presently being done in the hydrotreating art because of these proposed regulations.

Hydrotreating, or in the case of sulfur removal, hydrodesulfurization, is well known in the art and typically requires treating a petroleum stream with hydrogen in the presence of a metal sulfide catalyst at hydrotreating conditions. The catalyst is typically comprised of a Group VI metal with one or more Group VIII metals as promoters on a refractory support, such as alumina. Hydrotreating catalysts that are particularly suitable for hydrodesulfurization, as well as hydrodenitrogenation, generally contain molybdenum or tungsten on alumina promoted with a metal such as cobalt, nickel, iron, or a combination thereof For example, cobalt promoted molybdenum on alumina catalysts are widely used for hydrodesulfurization. Nickel promoted molybdenum on alumina catalysts are also widely used for hydrodenitrogenation, partial aromatic saturation, as well as some hydrodesulfurization.

Attempts have been made to produce distillates having very low sulfur levels. Examples of these attempts include: the use of multi-stage processes that permit the separation of liquid and vapor between stages; the use of sulfur sensitive catalysts in a second stage; the use of alternative reactor designs in different stages; the hydrogenation or removal of aromatics; the preparation of various specialty products, other than low-sulfur products; and the use of a continuous excess supply of hydrogen. For example, Published United States Patent Application Number 2003/0168383 A1 teaches the use of at least five times the molar rate of chemical hydrogen consumption, but there is no definition of the term "chemical hydrogen consumption". It would be extremely difficult to determine chemical hydrogen consumption "a priori" since one does not know how much hydrogen is used for aromatics hydrogenation, hydrodenitrogenation, and hydrocracking. Also, chemical hydrogen consumption would most likely be a function of hydrogen treat gas rate. The so-called "five-times" rule, if applicable, cannot be optimum over a wide range of hydrogen pressures. For example, in high-pressure operations, the so-called "five times" rule, may specify a treat gas rate (TGR) that is far in excess of what is needed to supply the catalyst surface with hydrogen. On the other hand, in low-pressure operations it may specify a TGR that is still short of what is needed to supply the desired surface hydrogen concentration. Moreover, the "five-times" rule does not consider other feedstock properties that are critical to desulfurization effectiveness.

Therefore, while various process scenarios have been developed for achieving deep desulfurization of petroleum distillate feedstocks, there still remains a need for ever improved, more efficient, and cost effective processes for achieving deep desulfurization of such feedstocks.

SUMMARY OF THE INVENTION

In accordance with the present invention there is provided a process for hydrodesulfurizing a distillate boiling range feedstream, which process includes determining a minimum treat gas rate ($TGR_m$) for hydrogen treat gas in accordance with the following:

$$TGR_m = \frac{1000(N/15)^a(42/API)^b(0.1+S/0.1)^c}{(0.2+PH/80)^d}$$

in which a, b, c, and d are positive numbers, N is nitrogen in wppm of said distillate boiling range feedstream, S is sulfur in wt. % of said distillate boiling range feedstream, API is API gravity of said distillate boiling range feedstream, and PH is a hydrogen partial pressure in psia, wherein $0.1 \leqq a \leqq 0.6$, $0.3 \leqq b \leqq 1.5$, $0.1 \leqq c \leqq 0.4$, and $0.1 \leqq d \leqq 0.8$. Said distillate boiling range feedstream is then contacted with a hydrogen treat gas and a hydrodesulfurization catalyst comprised of at least one Group VIII metal and at least one Group VI metal on a refractory support, at hydrodesulfurization conditions including a hydrogen partial pressure PH, to produce a distillate product stream having a substantially lower level of sulfur than the original distillate boiling range feedstream, the hydrogen treat gas being provided at a treat gas rate of at least $TGR_m$.

In a preferred embodiment the values for a, b, c, and d are in the ranges $0.2 \leqq a \leqq 0.5$, $0.4 \leqq b \leqq 1.2$, $0.1 \leqq c \leqq 0.3$, and$0.1 \leqq d \leqq 0.6$.

In another preferred embodiment the values for a, b, c and d are in the ranges of $0.25 \leqq a \leqq 0.4$, $0.4 \leqq b \leqq 1.0$, $0.1 \leqq c \leqq 0.25$, and $0.1 \leqq d \leqq 0.4$.

In yet another preferred embodiment, the values for a, b, c and d are a=0.3, b=0.8, c=0.2, and d=0.3.

In another preferred embodiment the distillate feedstream is a middle distillate feedstream.

In still another preferred embodiment the hydrodesulfurization catalyst is a large pore catalyst have an average pore diameter is greater than 50 angstroms (Å), more preferably larger than 80 Å, and most preferably greater than 120 Å.

DETAILED DESCRIPTION OF THE PREFERRED EMBODIMENTS

Figure 1:
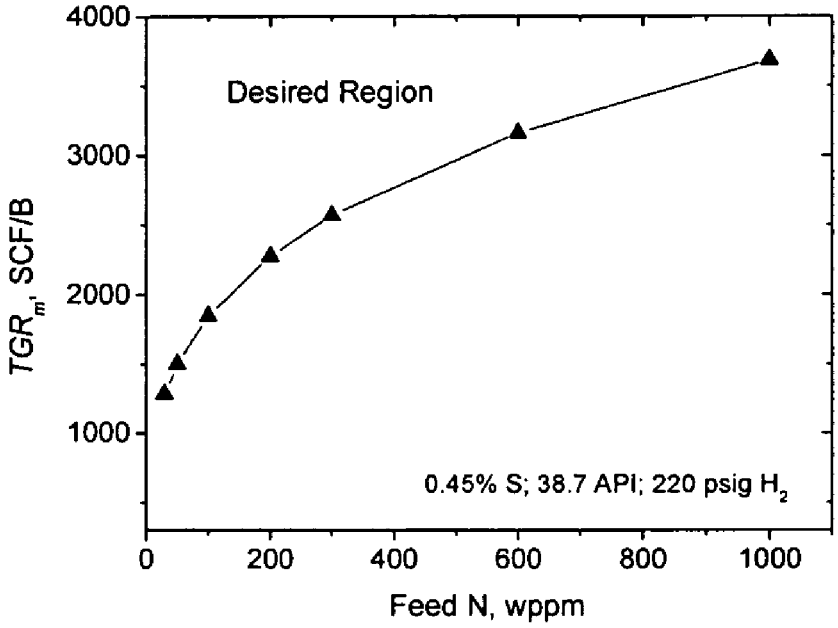
FIG. 1 hereof is a plot of hydrogen TGR as a function of feed nitrogen for a distillate feedstock containing 0.45 wt. % sulfur and having an API Gravity of 38.7. The hydrogen pressure is 220 psig.
Figure 2:
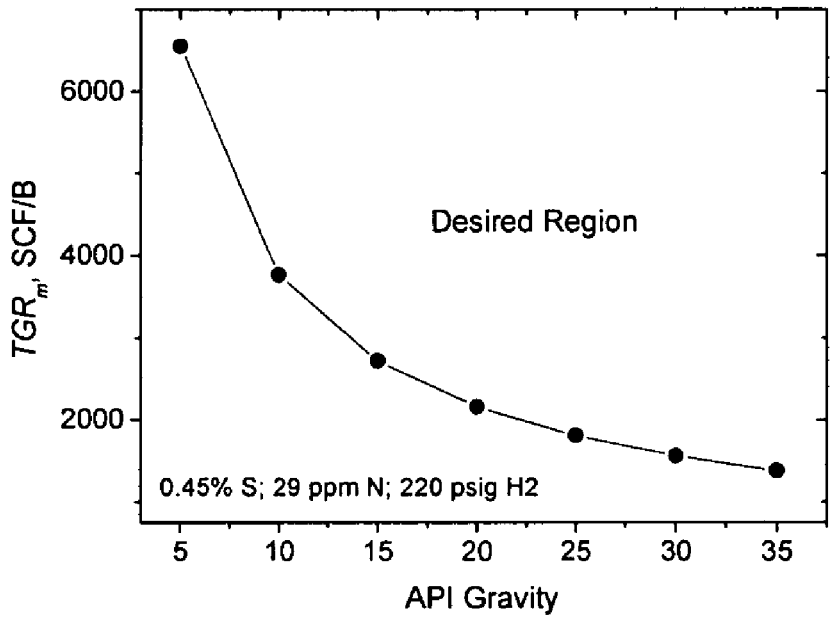
FIG. 2 hereof is a plot of hydrogen treat gas rate as a function of API Gravity for a distillate feedstock containing 0.45 wt. % sulfur and 29 wppm nitrogen at 220 psig hydrogen pressure.

Deep hydrodesulfurization of distillates, such as distillate boiling range fuels, is a hydrogen-intensive process requiring catalysts having strong hydrogenation functionality. By deep it is meant that the sulfur content of the liquid effluent after desulfurization is equal or less than 10 wppm. Highly hydrogenative catalysts have a huge appetite for surface hydrogen. Thus, the supply of hydrogen to the catalyst surface is a critical factor for deep hydrodesulfurization of distillates. This is especially so at low hydrogen pressures when the catalyst surface is generally starved of adsorbed hydrogen because of low hydrogen solubility, and/or slow mass transfer.

Besides hydrogen supply, there is another limiting factor in deep hydrodesulfurization. As the extent of the desulfurization gets deeper, the hydrodesulfurization rate becomes increasingly more inhibited by the presence of indigenous nitrogen compounds. This problem becomes more acute at low hydrogen pressures because the hydrodenitrogenation rate is a strong decreasing function of the hydrogen pressure. Moreover, nitrogen heterocycles are known to have a strong tendency to form coke, thus shortening the catalyst cycle length. Thus, the hydrogen supply and nitrogen inhibition are two critical factors that limit deep hydrodesulfurization levels at low hydrogen pressures.

Feedstreams suitable for being treated by the process of this invention are those petroleum-based hydrocarbon feedstreams boiling in the distillate range and above. Such feedstreams typically have a boiling range from about 150° C. to about 400° C., preferably from about 175° C. to about 370° C., at atmospheric pressure.

The distillate hydrocarbon feedstream can comprise high and low sulfur virgin distillates derived from high- and low-sulfur crudes, coker distillates, catalytic cracker light and heavy catalytic cycle oils, and distillate boiling range products from hydrocracker and resid hydrotreater facilities. Generally, coker distillate and the light and heavy catalytic cycle oils are the most highly aromatic feedstock components, ranging as high as 80% by weight. The majority of coker distillate and cycle oil aromatics are present as mono-aromatics and di-aromatics with a smaller portion present as tri-aromatics. Virgin feedstocks, such as high and low sulfur virgin distillates, are lower in aromatics content ranging up to about 20% by weight aromatics. Generally, the aromatics content of distillate hydrocarbon feedstocks will range from about 5% by weight to about 80% by weight, more typically from about 10% by weight to about 70% by weight, and most typically from about 20% by weight to about 60% by weight, based on the total weight of the feedstock.

The distillate hydrocarbon feedstock sulfur concentration is generally a function of the high and low sulfur crude mix, the hydrodesulfurization capacity of a refinery per barrel of crude capacity, and the alternative dispositions of distillate hydrodesulfurization feedstock components. The higher sulfur distillate feedstock components are generally virgin distillates derived from high sulfur crude, coker distillates, and catalytic cycle oils from fluid catalytic cracking units processing relatively higher sulfur feedstocks. The sulfur content of these distillate feedstocks can range as high as 2% by weight elemental sulfur but generally range from about 0.1% by weight to about 1.0% by weight elemental sulfur.

The nitrogen content of the distillate hydrocarbon feedstock is also generally a function of the nitrogen content of the crude oil, the hydrodesulfurization capacity of a refinery per barrel of crude capacity, and the alternative dispositions of distillate hydrodesulfurization feedstock components. Higher nitrogen distillate feedstocks include coker distillates and catalytic cycle oils. These distillate feedstock components typically have a total nitrogen content ranging up to about 2,000 wppm, but preferably from about 1 wppm to about 900 wppm.

The term "hydrodesulfurization" as used herein refers to processes wherein a hydrogen-containing treat gas is used in the presence of a suitable catalyst that is primarily active for the removal of heteroatoms, preferably sulfur, and nitrogen, and to a lesser extent some hydrogenation of aromatics. Suitable hydrodesulfurization catalysts for use in the present invention are any conventional hydrodesulfurization catalyst and includes those that are comprised of at least one Group VIII metal, preferably Fe, Co or Ni, more preferably Co and/or Ni, and most preferably Co; and at least one Group VI metal, preferably Mo or W, more preferably Mo, on a relatively high surface area refractory support material, preferably alumina. Other suitable hydrodesulfurization catalyst supports include refractory oxides such as silica, zeolites, amorphous silica-alumina, titania-alumina, and mixtures thereof. Additives such as phosphorus can also be present. It is within the scope of the present invention that more than one type of hydrodesulfurization catalyst be used in the same reaction vessel and in the same reaction zone. It is also within the scope of this invention that two or more different catalyst can be used in two or more reaction stages with or without interstage separation and wherein each zone can independently be operated in co-current or counter-current mode with respect to treat gas versus flow of feedstock.

The Group VIII metal is typically present in an amount ranging from about 2 to 20 wt. %, preferably from about 4 to 15%. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support. Typical hydrodesulfurization temperatures range from about 200° C. to about 400° C. with a total pressure of about 50 psig to about 3,000 psig, preferably from about 100 psig to about 2,500 psig, and more preferably from about 150 to 1,500 psig. More preferred hydrogen partial pressures will be from about 50 to 2,000 psig, most preferably from about 75 to 800 psig.

It is preferred that the catalyst be a suitably large pore size catalyst. That is, it is preferred that the catalyst have an average pore diameter is greater than about 50 Å, more preferably larger than about 80 Å, and most preferably greater than about 120 Å.

The hydrodesulfurization process of the present invention generally begins with a middle distillate feedstock preheating step. The feedstock is preheated in feed/effluent heat exchangers prior to final preheating to a targeted reaction zone inlet temperature that will assist in achieving the desired vaporization rate. The feedstock can be contacted with the hydrogen-containing treat gas stream prior to, during, and/or after preheating.

The hydrogen treat gas stream can be pure hydrogen, or can be in admixture with diluents such as low-boiling hydrocarbons, carbon monoxide, carbon dioxide, nitrogen, water, sulfur compounds, and the like. The hydrogen purity should be at least about 50% by volume hydrogen, preferably at least about 65% by volume hydrogen, and more preferably at least about 75% by volume hydrogen for best results. Hydrogen can be supplied from any suitable source, such as from a hydrogen plant, a catalytic reforming facility, or other hydrogen-producing or hydrogen-recovery processes.

The reaction zone can be comprised of one or more reactors containing one or more beds of the same or different catalysts. A reactor can also contain a plurality of catalyst beds of the same or different catalysts. In a preferred embodiment, the hydrodesulfurization process of the present invention comprises a plurality of reaction stages, each stage of which can be comprised of one or more catalyst beds or one or more reactors containing each containing one or more catalyst beds.

Since the hydrodesulfurization reaction is generally exothermic, interstage cooling, consisting of a heat transfer device between stages can be employed. At least a portion of the heat generated from the hydrodesulfurization process can be recovered for use in the hydrodesulfurization process. Suitable heat sinks for absorbing such heat provided by the hydrodesulfurization reaction exotherm can include the feedstock preheat section of the hydrodesulfurization process upstream of the reactor preheat furnace. Where this heat recovery option is not available, cooling of the reaction zone effluent may be performed through cooling utilities such as cooling water or air, or through use of a hydrogen quench stream injected directly into the reactors.

The reaction zone effluent is generally cooled and directed to a separator device to remove the hydrogen, some of which can be recycled back to the process while some of the hydrogen can be purged to external systems such as plant or refinery fuel. The hydrogen purge rate is preferably controlled to maintain a minimum hydrogen purity and to remove hydrogen sulfide. Recycled hydrogen is generally compressed, supplemented with "make-up" hydrogen, and re-injected into the process.

As previously mentioned, deep hydrodesulfurization of distillates, such as diesel fuels, is a hydrogen-intensive process requiring catalysts having strong hydrogenation functionality. As mentioned, by deep hydrodesulfurization we mean the sulfur concentration of the liquid product is equal or less than 10 wppm. Highly hydrogenative catalysts have a huge appetite for surface hydrogen. Thus, the supply of hydrogen to the catalyst surface is a critical factor in ultra-deep hydrodesulfurization of distillates. This is especially so at low hydrogen pressure when the catalyst surface is generally starved of adsorbed hydrogen because of low hydrogen solubility, and/or slow mass transfer.

Besides hydrogen supply, there is another limiting factor in ultra-deep hydrodesulfurization. As the extent of hydrodesulfurization gets deeper and deeper, the hydrodesulfurization rate becomes increasingly more inhibited by indigenous nitrogen compounds. This problem becomes more acute at low hydrogen pressures because the hydrodenitrogenation rate is a strong decreasing function of hydrogen pressures. Moreover, nitrogen heterocycles are known to have a strong tendency to form coke, thus shortening the catalyst cycle length. Thus, the hydrogen supply and nitrogen inhibition are critical factors limiting deep hydrodesulfurization levels at low hydrogen pressures. In light of this, the present invention relates to a method for adaptively adjusting the hydrogen treat gas rate to the catalyst surface to ensure a commensurately fast, and optimum supply of surface hydrogen for the hydrodesulfurization of different feeds over a wide range of hydrogen pressures. In so doing, one is able to achieve the desired deep hydrodesulfurization level and increase the catalyst cycle time.

The process of the present invention generally operates at a liquid hourly space velocity (LHSV) of from about 0.2 $hr^{-1}$ to about 10.0 $hr^{-1}$, preferably from about 0.5 $hr^{-1}$ to about 4.0 $hr^{-1}$ and most preferably from about 1.0 $hr^{-1}$ to about 2.0 $hr^{-1}$ for best results. Excessively high space velocities will result in reduced overall hydrodesulfurization.

As previously mentioned the practice of the present invention delivers a sufficient and optimum flow of hydrogen-containing treat gas to the catalyst surface commensurate with feedstock properties and hydrogen pressure, thereby enhancing deep hydrodesulfurization. Specifically, the hydrogen is provided at a TGR in accordance with the following prescription: the desired TGR is greater than a minimum value of TGR, denoted by $TGR_m$, which is defined as $$TGR_m = \frac{1000(N/15)^a(42/API)^b(0.1+S/0.1)^c}{(0.2+PH/80)^d}$$

in which a, b, c, and d are positive numbers and the units for N, S and PH are wppm, wt %, and psia, respectively, and wherein $0.1 \leqq a \leqq 0.6$, $0.3 \leqq b \leqq 1.5$, $0.1 \leqq c \leqq 0.4$, and $0.1 \leqq d \leqq 0.8$.The preferred ranges are $0.2 \leqq a \leqq 0.5$, $0.4 \leqq b \leqq 1.2$, $0.1 \leqq c \leqq 0.3$, and $0.1 \leqq d \leqq 0.6$. The most preferred ranges are $0.25 \leqq a \leqq 0.4$, $0.4 \leqq b \leqq 1.0$, $0.1 \leqq c \leqq 0.25$, and $0.1 \leqq d \leqq 0.4$.

API is the American Petroleum Institute gravity, or API gravity and is a measure of how heavy or light a petroleum liquid is compared to water. For example, if the API gravity is greater than 10, it is lighter than water, if less than 10 it is heavier than water. In other words, the API gravity is a measure of the relative density of a petroleum liquid and the density of water and thus has no units. For purposes of this invention API is defined as $^{o}API=141.5/SG-131.5$ where SG is the specific gravity. PH is the partial pressure of hydrogen. The feedstock's nitrogen and sulfur contents are denoted by N and S, respectively.

As an example, the following formula is one of preferred embodiments for practicing the present invention:

$$TGR_m = \frac{1000(N/15)^{0.3}(42/API)^{0.8}(0.1+S/0.1)^{0.2}}{(0.2+PH/80)^{0.3}}$$

It will be noted that $TGR_m$ is an increasing function of N/S and a decreasing function of API and PH. There is an upper bound on $TGR_m$, called $TGR_v$, which is the TGR corresponding to the onset of complete feed vaporization. The criteria for selecting TGR are:

$$TGR > TGR_m \text{ if } TGR_m < TGR_v$$

$$TGR = TGR_m \text{ if } TGR_m \geqq TGR_v$$

The above criteria should be used on a relative basis for assessing the interplay of feedstock properties and the desired TGR. Once the desired TGR is determined in accordance with the above prescription, one then can further adjust the reaction temperature and/or liquid hourly space velocity to further reduce sulfur levels in the liquid products.

What is claimed is:

1. A process for hydrodesulfurizing a distillate boiling range feedstream, which process comprises, determining a minimum treat gas rate ($TGR_m$) for hydrogen treat gas in accordance with the following:

$$TGR_m = \frac{1000(N/15)^a(42/API)^b(0.1+S/0.1)^c}{(0.2+PH/80)^d}$$

in which a, b, c, and d are positive numbers, N is nitrogen in wppm of said distillate boiling range feedstream, S is sulfur in wt. % of said distillate boiling range feedstream, API is API gravity of said distillate boiling range feedstream, and PH is a hydrogen partial pressure in psia, wherein $0.1 \leqq a \leqq 0.6$, $0.3 \leqq b \leqq 1.5$, $0.1 \leqq c \leqq 0.4$, and $0.1 \leqq d \leqq 0.8$; and contacting said distillate boiling range feedstream with a hydrogen treat gas and a hydrodesulfurization catalyst comprised of at least one Group VIII metal and at least one Group VI metal on a refractory support, at hydrodesulfurization conditions including a hydrogen partial pressure PH, to produce a distillate product stream having a substantially lower level of sulfur than the original distillate boiling range feedstream, the hydrogen treat gas being provided at a treat gas rate of at least $TGR_m$.

2. The process of claim 1 wherein the values for a, b, c, and d are in the ranges $0.2 \leqq a \leqq 0.5$, $0.4 \leqq b \leqq 1.2$, $0.1 \leqq c \leqq 0.3$, and $0.1 \leqq d \leqq 0.6$.

3. The process of claim 2 wherein the values for a, b, c and d are in the ranges of $0.25 \leqq a \leqq 0.4$, $0.4 \leqq b \leqq 1.0$, $0.1 \leqq c \leqq 0.25$, and $0.1 \leqq d \leqq 0.4$.

4. The process of claim 1 wherein the catalyst contains one Group VIII metal present which is Co and at least one Group VI metal which is Mo.

5. The process of claim 4 wherein the amount of Group VIII metal is from about 2 to about 20 wt. % and the amount of Group VI metal is from about 5 to 50 wt. %, based on the total weight of the catalyst.

6. The process of claim 5 wherein the amount of Group VII metal is from about 4 to 15 wt. % and the amount of Group VI metal is from about 10 to about 40 wt. %.

7. The process of claim 1 wherein the feedstream has a boiling range from about 150° C. to about 400° C.

8. The process of claim 7 wherein the distillate feedstream is a middle distillate feedstream.

9. The process of claim 1 wherein the hydrodesulfurization catalyst has an average pore diameter greater than about 50 Å.

10. The process of claim 9 wherein the average pore diameter is greater than about 80 Å.

11. The process of claim 10 wherein the feedstream is selected from the group consisting of high and low sulfur virgin distillates derived from high- and low-sulfur crudes, coker distillates, catalytic cracker light and heavy catalytic cycle oils, and distillate boiling range products from hydrocracker and resid hydrotreater facilities.

12. The process of claim 1 wherein the feedstream has an elemental sulfur content ranging from about 0.1 wt. % to about 1.0 wt. %.

13. A process for hydrodesulfurizing a distillate boiling range feedstream, boiling in the range of about 150° C. to about 400° C., which process comprises, determining a minimum treat gas rate ($TGR_m$) for hydrogen treat gas in accordance with the following:

$$TGR_m = \frac{1000(N/15)^{0.3}(42/API)^{0.8}(0.1+S/0.1)^{0.2}}{(0.2+PH/80)^{0.3}}$$

where N is nitrogen in wppm of said distillate boiling range feedstream, S is sulfur in wt. % of said distillate boiling range feedstream, API is API gravity of said distillate boiling range feedstream, and PH is a hydrogen partial pressure in psia; and contacting said distillate boiling range feedstream with a hydrogen treat gas and a hydrodesulfurization catalyst comprised of at least one Group VIII metal and at least one Group VI metal on a refractory support, at hydrodesulfurization conditions including a hydrogen partial pressure PH, to produce a distillate product stream having a substantially lower level of sulfur than the original distillate boiling range feedstream, the hydrogen treat gas being provided at a treat gas rate of at least $TGR_m$.

14. The process of claim 13 wherein the distillate feedstream is a middle distillate feedstream.

15. The process of claim 13 wherein the hydrodesulfurization catalyst has an average pore diameter greater than about 50 Å.

16. The process of claim 15 wherein the average pore diameter is greater than about 80 Å.

17. The process of claim 13 wherein the feedstream has an elemental sulfur content ranging from about 0.1 wt. % to about 1.0 wt. %.

* * * * *